US011175012B1

(12) United States Patent
Ai et al.

(10) Patent No.: US 11,175,012 B1
(45) Date of Patent: Nov. 16, 2021

(54) INDIRECT LIGHT WALL PACK

(71) Applicant: ABL IP Holding LLC, Atlanta, GA (US)

(72) Inventors: Qi Ai, Peachtree City, GA (US); Jie Chen, Snellvile, GA (US)

(73) Assignee: ABL IP Holding LLC, Atlanta, GA (US)

( * ) Notice: Subject to any disclaimer, the term of this patent is extended or adjusted under 35 U.S.C. 154(b) by 0 days.

(21) Appl. No.: 16/923,588

(22) Filed: Jul. 8, 2020

(51) Int. Cl.

| | |
|---|---|
| ***F21V 7/09*** | (2006.01) |
| ***F21V 7/00*** | (2006.01) |
| ***F21V 29/70*** | (2015.01) |
| ***F21V 3/04*** | (2018.01) |
| ***F21S 8/00*** | (2006.01) |
| ***F21V 7/08*** | (2006.01) |
| ***F21V 7/06*** | (2006.01) |
| ***F21V 7/07*** | (2006.01) |
| *F21Y 115/10* | (2016.01) |
| *F21Y 103/10* | (2016.01) |

(52) U.S. Cl.
CPC ..... *F21V 7/0008* (2013.01); *F21S 8/033* (2013.01); *F21V 3/049* (2013.01); *F21V 7/005* (2013.01); *F21V 7/06* (2013.01); *F21V 7/07* (2013.01); *F21V 7/08* (2013.01); *F21V 7/09* (2013.01); *F21V 29/70* (2015.01); *F21Y 2103/10* (2016.08); *F21Y 2115/10* (2016.08)

(58) Field of Classification Search
CPC ..... F21S 8/033; F21V 29/70; F21V 3/049; F21V 7/005; F21V 7/06; F21V 7/07; F21V 7/08; F21V 7/0008; F21V 7/09
See application file for complete search history.

(56) References Cited

U.S. PATENT DOCUMENTS

| | | | | |
|---|---|---|---|---|
| 8,113,680 | B2 | 2/2012 | O'Brien et al. | |
| 8,197,105 | B2 * | 6/2012 | Yang | A47F 3/001 362/346 |
| 8,297,798 | B1 * | 10/2012 | Pittman | F21V 7/28 362/296.05 |
| 8,651,692 | B2 * | 2/2014 | Yang | F21V 9/38 362/235 |
| 9,458,972 | B1 * | 10/2016 | Dong | F21V 5/045 |
| 10,222,026 | B2 * | 3/2019 | Kim | F21S 8/04 |
| 10,222,028 | B2 * | 3/2019 | Hesse | F21V 19/003 |

* cited by examiner

*Primary Examiner* — Arman B Fallahkhair
(74) *Attorney, Agent, or Firm* — Kilpatrick Townsend & Stockton LLP

(57) ABSTRACT

A light fixture for lighting a surface includes a housing, a plurality of light sources, and a reflector for directing light out of a window of the housing. The plurality of light sources are directed away from the window of the housing and are then not directly viewable from the exterior of the housing while providing light reflected against the reflector through the window of the housing. The light sources are connected to a substrate through which power is supplied to the light sources and through which heat energy is removed from the light sources during operation. The substrate may form a portion of the housing of the light fixture.

18 Claims, 6 Drawing Sheets

INDIRECT LIGHT WALL PACK

BACKGROUND

One particular type of light fixture is known as a wall pack light fixture. Wall pack light fixtures are widely used as commercial, outdoor lighting fixtures due to their durability and efficient lighting over large areas. A wall pack light fixture is typically installed to a support structure, such as a vertical wall or post. The wall pack light fixture typically houses one or more light sources for providing illumination to a desired illuminated area. Typically, the one or more light sources are positioned behind a transparent barrier through which the light exits the light fixture. The light sources may be directly viewable through the transparent barrier and may cause glare or discomfort due to the brightness of the direct light when viewed by passers-by.

BRIEF SUMMARY

Embodiments of the invention covered by this patent are defined by the claims below, not this summary. This summary is a high-level overview of various aspects and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to the entire specification of this patent, all drawings, and each claim.

A system for providing indirect light from a wall pack light fixture. The light source may not be visible from outside the housing of the light fixture or, in some examples, may only be indirectly visible. One general aspect includes a light fixture for lighting an illuminated surface, the light fixture including a housing and a plurality of light sources positioned within the housing and directed towards an interior of the housing. The light fixture also includes a window through which light originating from the light sources passes to exit the housing, the plurality of light sources positioned adjacent a first edge of the window. The light fixture also includes a reflector towards which the light sources are directed, the reflector extending from the plurality of light sources to a second edge of the window opposite the first edge, the reflector extending along a first axis perpendicular to the first edge of the window, the reflector curved around the first axis to reflect light from the plurality of light sources, where the plurality of light sources and reflector cooperate to direct light produced by the light sources onto the illuminated surface in an illumination field that is generally rectangular.

Implementations of the light fixture may include one or more of the following features. The light fixture further may include a heat sink connected to the plurality of light sources. The heat sink may form a portion of an access panel providing access to an interior of the housing. The reflector may have a freeform curvature within a plane perpendicular to the first axis. The reflector may include a plurality of arc segments tangent with respect to adjacent arc segments. The reflector may include a curvature having a profile of an arc segment of an ellipse. The reflector may include a parabolic curvature. The reflector may include a hyperbolic curve. The reflector may include a first portion perpendicular to the window and a second portion having a curved profile. The reflector may be curved with a first radius of curvature at a first end of the reflector and a second radius of curvature at a second end of the reflector. The first radius of curvature may be smaller than the second radius of curvature. The reflector may reflect light from the plurality of light sources and direct it away from a supporting structure to which the housing is connected. The window may include a textured surface to scatter light from the plurality of light sources. The window may include a volumetric diffuser to scatter light from the plurality of light sources. The plurality of light sources may include light emitting diodes (LEDs).

Another general aspect includes a light fixture, including a light source that directs light in a first direction with a heat transfer device connected to the light source to dissipate heat generated by the light source. The light fixture also includes a window through which light originating from the light source passes, the light source directed away from the window. The light fixture also includes a reflector positioned opposite the window in the first direction, the reflector being curved with a varying radius of curvature over a length of the reflector, where the light from the light source reflects off the reflector towards the window.

Implementations may include one or more of the following features. The reflector may have a first radius of curvature adjacent the light source and a second radius of curvature at a distant end of the reflector from the light source. The first radius of curvature may be smaller than the second radius of curvature. The reflector may include a plurality of arc segments tangent with respect to adjacent arc segments. A first arc segment of the plurality of arc segments adjacent the light source may have a first radius of curvature and a second arc segment of the plurality of arc segments adjacent the first arc segment may have a second radius of curvature, the first radius of curvature smaller than the second radius of curvature. The heat transfer device may include a portion of an access panel to an interior of the light fixture.

BRIEF DESCRIPTION OF THE DRAWINGS

A further understanding of the nature and advantages of various embodiments may be realized by reference to the following figures. In the appended figures, similar components or features may have the same reference label. Further, various components of the same type may be distinguished by following the reference label by a dash and a second label that distinguishes among similar components. If only the first reference label is used in the specification, the description is applicable to any one of the similar components having the same first reference label irrespective of the second reference label.

DETAILED DESCRIPTION

Figure 1:
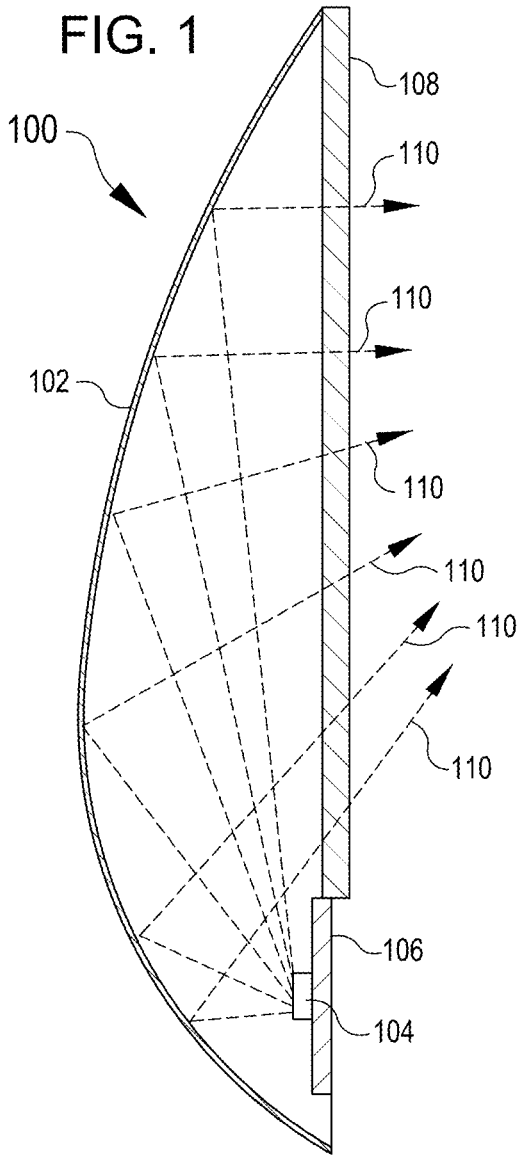
FIG. 1 illustrates a side view of an indirect light fixture with ray traces of light from an LED, according to some embodiments.

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

In the interest of clarity, not all of the routine features of the examples described herein are shown and described. It will, of course, be appreciated that in the development of any such actual implementation, numerous implementation-specific decisions need to be made in order to achieve the developer's specific goals, such as compliance with application- and business-related constraints, and that these specific goals will vary from one implementation to another and from one developer to another.

Typical wall pack lights use direct light sources with reflectors and refractors to generate an asymmetrical distribution. These typical wall pack lights typically cause glares and can be difficult for a passerby to view because of the direct view of the light source. The embodiments described herein include a light source, typically one or more light emitting diodes (LEDs) on a bottom edge of a wall pack fixture and direct the light against a reflector to distribute the light asymmetrically or symmetrically, based on the needs of the lighting area. The arrangement of wall packs and light fixtures contained therein provide several benefits over previous systems. The indirect light prevents passers-by from looking directly at the light source, whether intentionally or unintentionally. Additionally, the curvature of the reflector and the asymmetrical distribution of light from the wall pack enable the wall pack light to throw light away from the supporting structure holding up the wall pack, such as a post or wall. The distribution of light away from the supporting structure allow the wall pack to light an illuminated surface without expending resources illuminating an unnecessary area, such as a wall. Furthermore, the reflector of the indirect light can be injection molded, or otherwise manufactured to carefully control the distribution of light from the fixture.

Embodiments of the present disclosure are directed to, among other things, a light fixture for lighting a surface. The light fixture is positioned within a housing, the housing securable to a supporting structure such as a wall, post, beam, or other such structure. A number of light sources, such as light emitting diodes (LEDs) are positioned within the housing near a window and directed generally away from the window and therefore away from the illuminated surface. Though the embodiments described herein are described with reference to LEDs, other light sources including incandescent, fluorescent, halogen, and any other suitable light source may be used in place of the LEDs. A reflector is positioned in the path of the light from the LEDs such that the light is reflected from the LEDs and directed out of the housing through the window. The LEDs are connected to a printed circuit board (PCB) or other mounting device that may also serve as a heat sink to remove heat energy produced by the LEDs during operation and prevent damage to the LEDs, housing, or reflector, especially during long periods of operation. The PCB may connect to a portion of the housing, such as an access panel or port and thereby direct heat energy from the LEDs to the exterior of the housing for efficient cooling of the light fixture in a convective manner.

The LEDs may be fully enclosed by the reflector, meaning that the light from the LEDs is entirely captured by and reflected from the reflector through the window, such as a glass lens. Because the reflector captures and reflects all of the light from the LEDs, due to the arrangement within the housing, the distribution of light over the illuminated surface is controllable, for example to ensure an even distribution of light, especially light thrown forward from the light fixture and therefore reduces waste on lighting a portion of the supporting structure.

FIG. 1 illustrates a side view of an light fixture 100 with ray traces 110 of light from an LED 104, according to some embodiments. Driver electronics and wiring have been omitted from FIG. 1 for clarity of illustration, but it is to be understood that they are present as needed. A PCB 106 holds a number of light emitting diodes (LEDs) 104. In this embodiment, only one LED 104 is visible, but more may be included in an array adjacent to the visible LED 104. For example, the LEDs 104 may be in a row as described with respect to FIG. 3. In some examples, the LEDs 104 may be distributed in two directions or axes, covering a plane, rather than just a line. The LED 104 is pictured directed perpendicular to the window 108. This ensures that the LED 104 is not directly visible by a passerby at any angle. In some examples, the LED 104 may be directed at other angles besides perpendicular to the window 108, such as at angles of around or greater than forty-five degrees with respect to the window 108.

A reflector 102 is positioned opposite the LED 104 to reflect the light produced by the LED 104. The reflector 102 is curved to capture and reflect the light from the LED 104 out through the window 108. The reflector 102 is preferably configured to particular intended uses of the light fixture 100. For example, if the light fixture 100 is intended to be used in the middle portion of a large parking lot, then the reflector 102 may be configured to direct light downward in a symmetrical pattern. Though the light fixture 100 is shown with one reflector 102 that will produce an asymmetric pattern, a symmetrical pattern may be produced through the use of two or more reflectors 102 arrayed symmetrically. In some examples, a symmetric pattern may be accomplished through the use of an even number of reflectors 102 positioned opposite one another across a central axis of the light fixture 100. For example, two reflectors 102 may be arranged around a central axis or opposite one another to produce a symmetrical pattern. If the light fixture 100 will be used at the edge of a parking lot, or as a street light, then the reflector 102 may be configured to direct the light in an asymmetric pattern. A symmetrical pattern is one that is centered on a vertical axis of the light fixture. An asymmetrical pattern is one that is not centered on the vertical axis of the light fixture, for example a pattern that is directed toward the ground but away from a wall on which the light fixture is mounted.

The reflector 102 is configured to direct the light from the LEDs in a symmetric or asymmetric pattern based on the curvature of the reflector 102 in addition to directing the light to light the illuminated surface as desired. For example, a constant radius of curvature for the reflector 102 may result in a first distribution of light from the light fixture 100 while a changing or varying radius of curvature of the reflector 102 results in a second light distribution, for example to throw or direct light further away from the supporting structure holding the light fixture 100.

As shown, the reflector 102 has a tighter radius of curvature nearer to the LED 104 than at the distal end of the reflector 102 furthest away from the LED 104. In some examples, the curvature may be constant, vary linearly, or vary in any other manner over the length of the reflector 102. The curvature of the reflector 102 results in light that is even and consistent, without pixelation or breaks in the pattern of light thrown on the surface.

The reflector 102 is shown having a curvature in only a single direction, or only curved around a single axis. That is, the surface is made up of parallel straight lines, such that the reflector 102 is a portion of a non-circular cylinder. The reflector 102 is shown curved in only a single direction, though some embodiments may include a reflector 102 having curvature in two or more directions. Additionally, the reflector may have a substantially rectangular footprint, or in some examples, may have a footprint that is some other geometric shape such as circular or elliptical. The curvature of the reflector 102 may be constant along a width of the reflector 102, as shown and described with respect to FIG. 3. In some examples, the curvature of the reflector 102 may vary in two directions, for example with a central portion of the reflector 102 having a profile similar to that shown in FIG. 1, while the light fixture 100 has a different profile at different widths, i.e., into or out of the page of FIG. 1, For example, the reflector 102 may be curved to direct a center portion of light from the LEDs 104 further away from the light fixture 100 than edge portions of the light, which may be directed closer to the light fixture.

The reflector 102 is shown as a series of arc segments stitched together to form the changing radius of curvature of the reflector 102, from the tighter radius at or near the LED 104 to the relatively larger radius of curvature at the distal end of the reflector 102 away from the LED 104. The arc segments are tangent with respect to one another, such that no seam or crease is present in the reflector 102. In some examples, the arc segments may be circular arc segments, in some examples, the arc segments may be elliptical or semi-elliptical arc segments stitched together as described above or any combination of curves described herein. In some examples, the reflector 102 may have a hyperbolic or parabolic curvature, or portions of the reflector 102 may include parabolic or hyperbolic curves. In some examples, the reflector may also be a freeform shape. For example, the reflector 102 may have at least a portion that is not a curved shape (circle, ellipse, hyperbola, or parabola), and that may not be amenable to closed-form mathematical description.

In some examples, the reflector 102 may be formed of a number of line segments joined together. The line segments may be straight line segments or the curved segments described above. In the case of a straight line segment, the straight line segments may approximate the curve of the reflector 102 by dividing the profile of the reflector 102 into a plurality of straight line segments. Joined end to end, the straight line segments form the profile of the reflector 102. The straight line segments may be of constant length, for example between a few millimeters to over a centimeter in length. In some examples, the straight line segments may be of varying length, for example, with relatively shorter straight line segments used to approximate portions of the reflector 102 having a tight radius of curvature and relatively longer straight line segments used to approximate portions having a relatively larger radius of curvature.

In some examples, the reflector 102 may be defined by a series of points along the profile of the reflector 102. The points may be connected by straight line segments or arc segments as described above. The points lie on the desired curve of the profile of the reflector 102 with the arc or line segments connecting the points to form the full profile of the reflector 102.

Though the reflector 102 has been shown as a concave reflector 102, in some examples, the reflector may be convex, or include a convex portion, for example at the distal end of the reflector 102 from the LED 104, the reflector 102 may include a convex portion to further direct or throw light away from the supporting structure.

The reflector 102 may be formed in a freeform manner with a sheet metal product bent or curved in the desired profile. The surface of the reflector 102 may be a specular reflector to reflect the light from the LED 104. In other embodiments, the reflector 102 may be brushed, peened, etched, or otherwise textured at least in part. The desired profile may be determined based on a lumen mapping system or simulation, including a photometric polar diagram, such as shown and described with respect to FIG. 8 below. In some examples, the reflector 102 may be injection molded or otherwise fabricated of any suitable material that can hold the curved shape and subsequently coated with a specular coating to enable the reflection of light.

Figure 8:
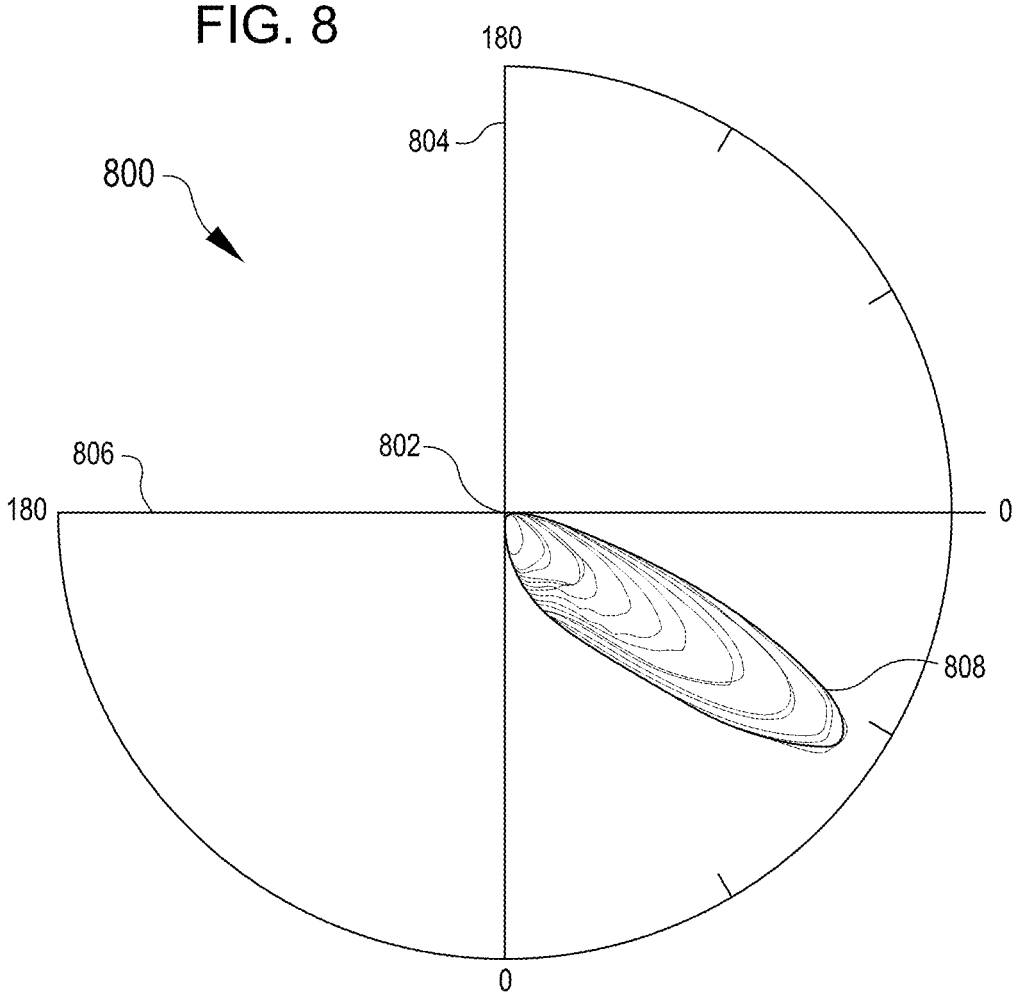
FIG. 8 shows a photometric polar diagram for an indirect light fixture, according to some embodiments.
Figure 9:
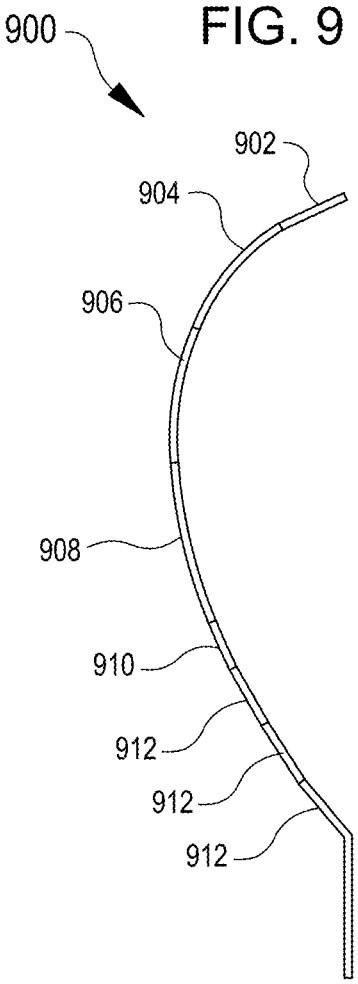
FIG. 9 shows a side view of a curved reflector including both curved and linear sections, according to some embodiments.
Figure 10:
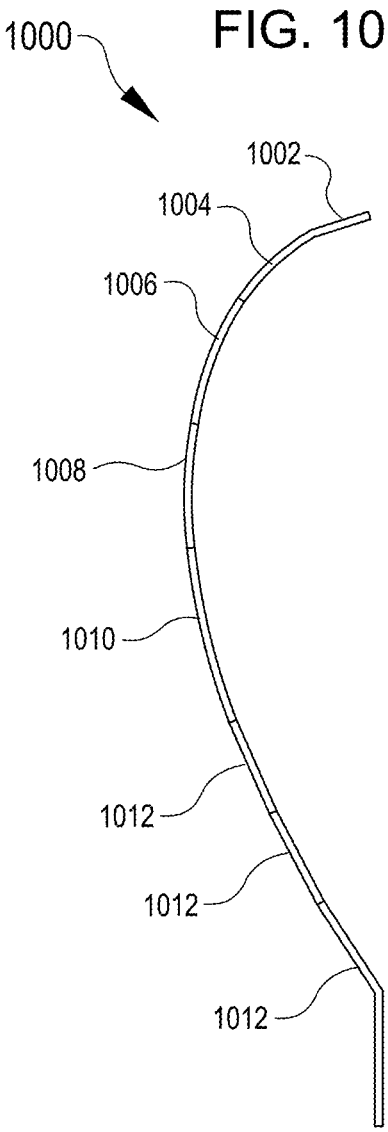
FIG. 10 shows a side view of a curved reflector including both curved and linear sections, according to some embodiments.

FIGS. 9 and 10 show side views of curved reflectors 900 and 1000 including both curved and linear sections that may be implemented for the reflector 102. Each of the curved reflectors 900 and 1000 include different segments or sections having different curvatures and shapes. The different profiles may result in different patterns of light on an illuminated surface, but will maintain the performance of the reflector as described herein with respect to FIGS. 1 and 8.

With respect to curved reflector 900, a first edge 902 of the curved reflector includes a flat or straight edge, similar to the truncated wall 212 of FIG. 2 described below. The first edge 902 may truncate the curved reflector 900 to prevent light from reflecting against the curved reflector 900 and returning to the light source, which may result in additional heat at the light source. The first edge of the curved reflector is at an angle of between sixty and eighty degrees with respect to the window of the housing. In some examples the first edge is at an angle of less than eighty degrees with respect to the window of the housing. Adjacent to the first edge 902 are curved sections 904, 906, 908, and 910. The curved sections 904, 906, 908, and 910 have different radii of curvature, with a radius of curvature of the curved section 904 less than a radius of curvature of the curved section 906. Similarly, the radius of curvature of the curved sections 908 and 910 are greater than the radius of curvature of the curved sections 904 and 906. The increasing radius of curvature along the curved reflector 900 as distance from the first edge 902 increases results in the forward throw of light as described with respect to FIG. 8. The curved sections 904, 906, 908, and 910 are tangent with respect to adjacent sections. In some examples, the curved sections 904, 906, 908, and 910 include angled joints between each section such that the curved sections 904, 906, 908. and 910 are not tangent with respect to adjacent sections. The angled joints may be formed as a result of a manufacturing process that allows the radii of the curved sections 904, 906, 908, and 910 to be formed without respect to forming perfect tangent edges.

Adjacent the curved section 910 are a series of straight sections 912. The straight sections 912 are each positioned at different angles with respect to one another. The straight sections 912 are each shown of similar lengths, though in some examples the straight sections 912 may each have different lengths, for example the straight sections 912 may increase in length with increasing distance from the first edge 902. A flange is positioned at the second edge of the curved reflector 900 for securing the curved reflector to a housing of the light fixture. A flange may also be positioned at the first edge 902 to secure the first edge to the housing.

The curved reflector 1000 has a profile including a flat first edge 1002 and a series of curved sections 1004, 1006, 1008, and 1010 with increasing radii of curvature as the distance from the first edge 1002 increases. The curved sections 1004, 1006, 1008, and 1010 also increase in length as the distance from the first edge 1002 increases. The flat sections 1012 are positioned at varying angles with respect to one another and with respect to a window of the housing.

Returning to FIG. 1, The window 108 of the light fixture 100 may be a lens formed of plastic, glass, or other transparent or semi-transparent materials through which the light from the LED 104 can travel. The window 108 may include a diffuser to further diffuse and adjust the distribution of light, for example to soften the appearance of the light or provide gentle transitions from lit to unlit regions on the illuminated surface. The window 108 may be made, for example, of polycarbonate, acrylic, glass, or another substantially transparent optical material, and include optical elements for redirecting the light from the LEDs 104 into desired distributions. A mounting frame holds the window 108 in position in the housing. In some embodiments, the window 108 may include multiple windows or surfaces through which the light travels, each conditioning or altering the light in some manner, some examples of windows or surfaces include a polarizing filter, diffuser, color filter, distribution lens, or other such elements.

FIG. 1 also shows a ray trace 110 of light from the LED 104 in a variety of directions indicating at least some of the paths of rays of light from the LED 104. Light from the LED 104 encounters the reflector 102, which is pictured as a concave surface, reflects into the window 108. The light travels through the window 108 and on to light the illuminated surface. Because of the geometry of the system, including the position of the LED 104 and the shape of the reflector 102, the uppermost rays from the LED 104 reflect and travel out of the housing through the window 108 in a direction generally opposite the direction of the LED 104. Through this configuration, the reflector 102 has a curvature that ensures that light from the LED 104 travels forward or away from the edge of the reflector 102 near the LED 104. For example, the uppermost ray trace 110 shows light reflecting against a distal portion of the reflector 102 and reflecting in a near-parallel and opposite direction to the primary orientation of the LED 104, but not directed back towards the LED 104. This enables the light fixture 100 to have forward throw and direct light away from a supporting structure, which may be nearest the end of the reflector 102 adjacent the LED 104.

Figure 2:
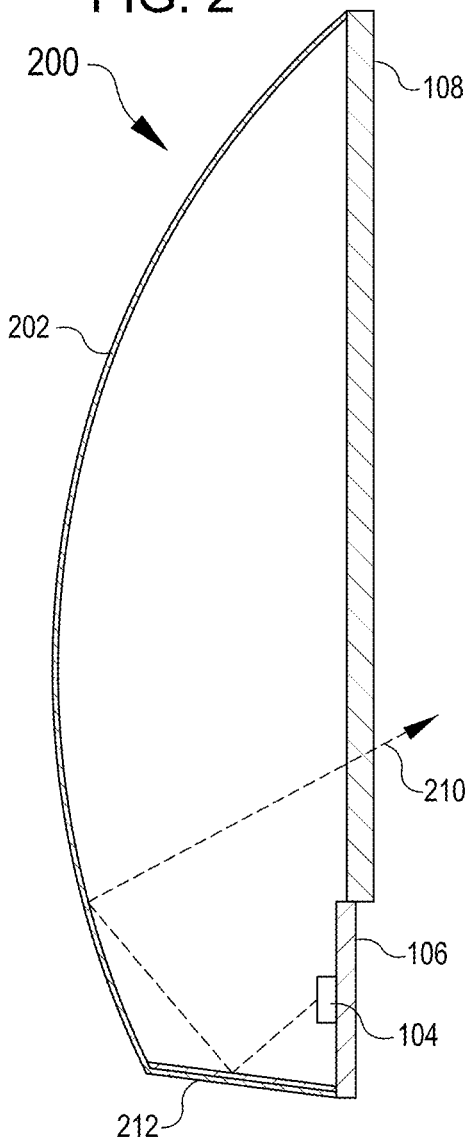
FIG. 2 shows a side view of an indirect light fixture with a truncated reflector and ray trace of light from an LED, according to some embodiments.

FIG. 2 shows a side view of a light fixture 100 with a truncated reflector 202 and ray trace 210 of light from an LED 104, according to some embodiments. The LED 104, PCB 106, and window 108 may all be similar or identical to those shown and described with respect to FIG. 1, and therefore share similar reference numerals.

The truncated reflector 202 is similar to the reflector 102, except with a truncated or shortened end nearest the LED 104. The truncated wall 212 of the reflector 202 prevents at least some light from reflecting from the LED 104 directly back onto the LED 104 and the PCB 106. Preventing at least some of this reflection may enable the light fixture 200 to reduce thermal energy imparted on the PCB 106 that must then be removed through a heat sink. The truncated wall 212 is shown having an orientation at less than ninety degrees with respect to the PCB 106 and the window 108, thereby ensuring the light is reflected off the truncated wall 212 and towards the window 108 to exit the housing of the light fixture. In some examples, the truncated wall 212 may be at an angle of around ninety degrees with respect to the PCB 106 and the window 108. In other examples, the truncated wall 212 may be at an angle of less than ninety degrees with respect to the PCB 106 or greater than ninety degrees with respect to the PCB 106.

The ray trace 210 shows how light from the LED 104 exits the LED 104 and reflects off of the truncated wall 212 before reflecting off the reflector 202 and exiting the housing through the window 108. Though shown with a single truncated portion, in some examples, the light fixture 200 may include one or more truncated walls 212 that reflect light from the LED 104 away from the LED 104 immediately, thereby reducing the thermal energy encountering the PCB 106. The multiple truncated walls 212 may be positioned adjacent to one another and at different angles with respect to the PCB 106.

Figure 3:
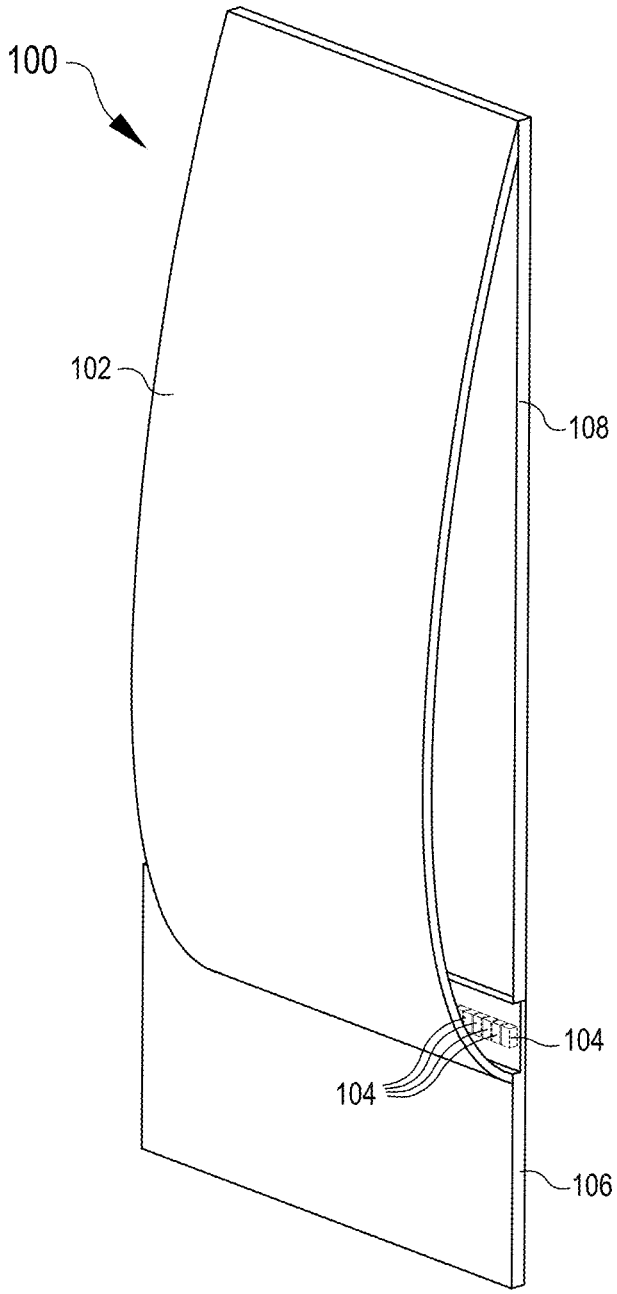
FIG. 3 shows a perspective view of the indirect light fixture of FIG. 1, showing a row of LED's and a curved reflector, according to some embodiments.

FIG. 3 shows a perspective view of the light fixture 100 of FIG. 1, showing a row of LEDs 104 and a reflector 102 curved around a single axis, according to some embodiments. That is, the surface of the reflector 102 is made up of parallel straight lines, such that the reflector 102 is a portion of a non-circular cylinder. The reflector 102 has a curvature in only one direction, wrapping around a single axis parallel to a line defined by the LEDs 104. As discussed above with respect to FIG. 1, the curvature of the reflector 102 may vary over both the length and the width of the reflector 102 to adjust the pattern of light as well as the throw of light from the light fixture 100 through the window 108. The PCB 106 may extend beyond the edge of the reflector 102, for example to provide electrical connections for the LEDs 104 as well as provide greater surface area or opportunities for heat transfer from the PCB 106. In some examples, as described with respect to FIGS. 4 through 7, the PCB 106 may include a heat sink that forms part of a housing of the light fixture 100 such as an access panel, door, or exterior wall of the housing. The heat sink may therefore release heat due to convection to the region surrounding the exterior of the light fixture 100, preventing thermal buildup within the housing.

Figure 4:
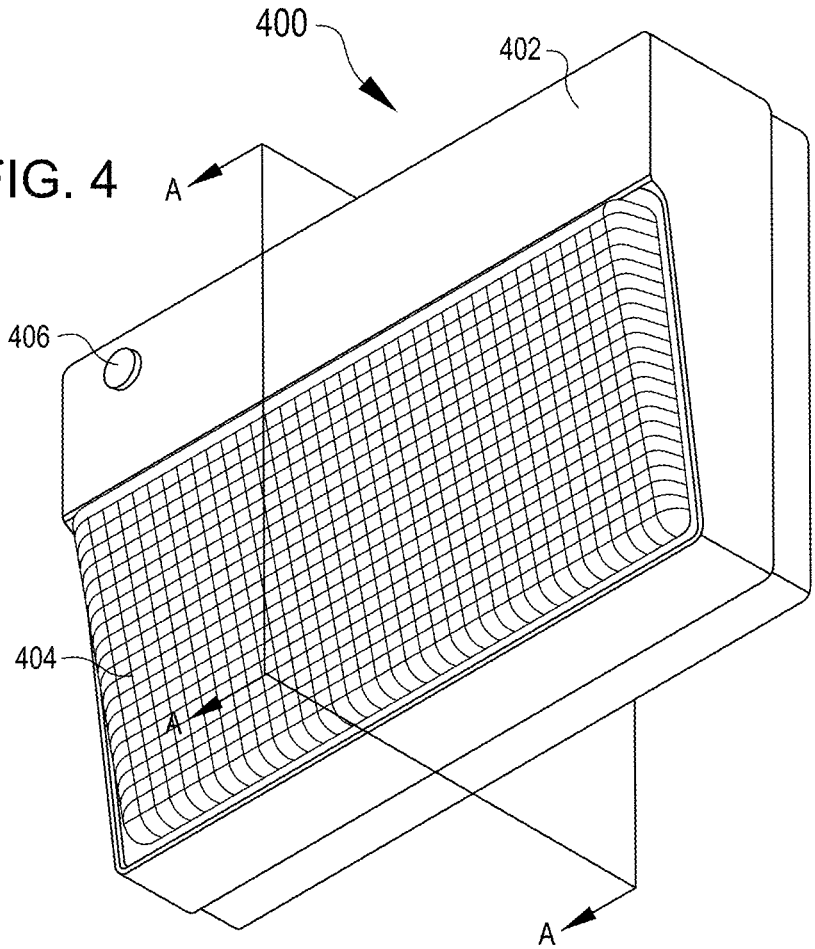
FIG. 4 shows a perspective view of a wall pack including an indirect light fixture, according to some embodiments.

FIG. 4 shows a perspective view of a wall pack 400 including an indirect light fixture, according to some embodiments. The wall pack 400 includes a housing 402 for mounting the wall pack 400 to a pole, post, beam, ceiling, wall, or other structure. The housing 402 may include cooling elements, mounting elements, access panels, in addition to a window 404 and a light detection element 406. The window 404 may be similar with respect to the description of the window 108. The light detection element 406 may include a photosensitive element for detecting a level or brightness of exterior light and be used to signal or trigger the wall pack 400 to produce light when the surrounding area is sufficiently dark.

The wall pack 400 may also receive electrical power through the housing 402 on a mounting side (not shown) where the wall pack 400 attaches to a wall or supporting structure. The wall pack 400 produces light, typically directed outward from the supporting structure and downward towards the illuminated surface such as a parking lot, but it will be recognized that some embodiments may be embodied in wall packs oriented in any direction. Terms such as "upward," "downward," "top," "bottom," and the like in this disclosure refer to the orientation of FIG. 4, but are not intended to limit the usage of the wall pack 400 to this orientation.

Figure 5:
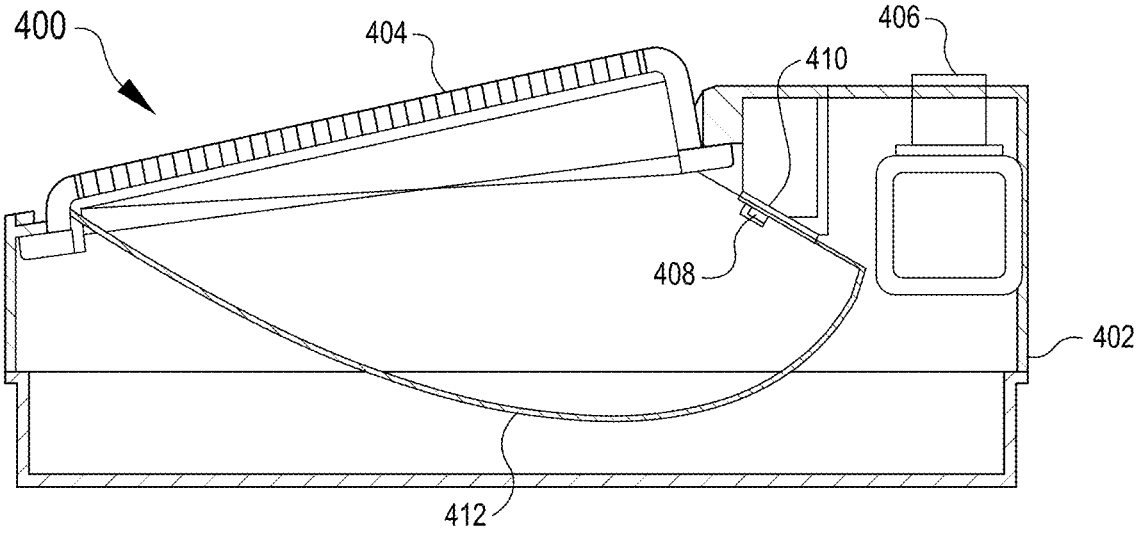
FIG. 5 shows a section view of the wall pack of FIG. 4, according to some embodiments.

FIG. 5 shows a section view of the wall pack 400 of FIG. 4 taken at plane A, according to some embodiments. The wall pack 400 includes the housing 402, window 404, and light detection element 406 as described above. Driver electronics and wiring have been omitted from FIG. 5 for clarity of illustration, but it is to be understood that they are present as needed. The wall pack 400 also includes an LED 408, a PCB 410, and a reflector 412. The LED 408, PCB 410, and reflector 412 may have similar structures and makeup to the LED 104, PCB 106, and reflector 102 described above.

The LED 408 and PCB 410 are shown directed diagonally generally towards an opposite corner of the housing 402 from the location of the LED 408. The orientation of the LED 408 and the PCB 410 may ensure that the light from the LED 408 reflects against the reflector and out of the housing 402 through the window 404 rather than reflecting back onto the PCB 410 and heating up the PCB 410 and LED 408. In some embodiments, the LED 408 and PCB 410 may be arranged as shown and described with respect to FIGS. 1 through 3, with the PCB 410 substantially parallel to the window 404. Furthermore, the truncated wall 212 of FIG. 2 and the associated reflector 202 may be substituted for the reflector 412. The reflector 412 receives the light from the LED 408 and reflects the light through the window 404 out of the housing 402 to light the illuminated surface. The varying radius of the reflector 412 ensures that light reflected off the reflector 412 and directed out through the window 404 is thrown or directed substantially away from the housing 402 and the supporting structure (not shown) which the housing 402 connects to at the bottom of the housing 402 as shown in FIG. 5.

The PCB 410 is thermally coupled to the housing 402, more specifically to a portion of an access panel of the housing 402 to provide a conduit for heat to transfer out of the housing 402. In some examples, the heat may be removed from the PCB 410 and LED 408 through passive means, such as convection and conduction with passive elements. In some examples, such as high power applications, the wall pack 400 may include active heat removal systems such as cooling fans, heat exchangers, or other such cooling means.

Figure 6:
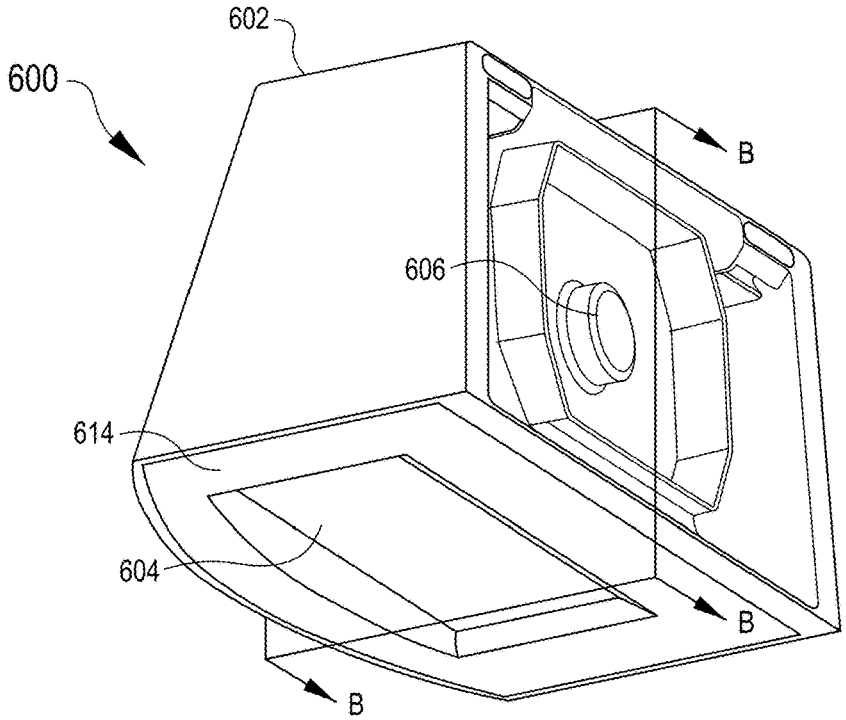
FIG. 6 shows a perspective view of a wall pack including an indirect light fixture, according to some embodiments.

FIG. 6 shows a perspective view of a wall pack 600 including an indirect light fixture, according to some embodiments. The wall pack 600 includes a housing 602 for mounting the wall pack 600 to a pole, post, beam, ceiling, wall, or other structure. The housing 602 includes a port 606 which may serve to provide an electrical connection into the interior of the housing 602 as well as a mounting structure for securing to a supporting structure. The housing 602 may include cooling elements, mounting elements, access panels, in addition to a window 604. The window 604 may be similar with respect to the description of the window 108. The window 604 may be held in a frame by a lower panel 614 of the housing 602. The lower panel 614 is removable to provide access into the housing 602, for maintenance, setup, and cleaning. The lower panel 614 may also function as a heat sink and heat dissipation device as described with respect to FIG. 7.

The wall pack 600 may also receive electrical power through the housing 602 on a mounting side, such as at port 606 where the wall pack 600 attaches to a wall or supporting structure. The wall pack 600 produces light, typically directed downward toward a surface such as a parking lot, but it will be recognized that the embodiments may be embodied in light fixtures oriented in any direction. Terms such as "upward," "downward," "top," "bottom," and the like in this disclosure refer to the orientation of FIG. 6, but are not intended to limit the usage of the wall pack 600 to this orientation.

Figure 7:
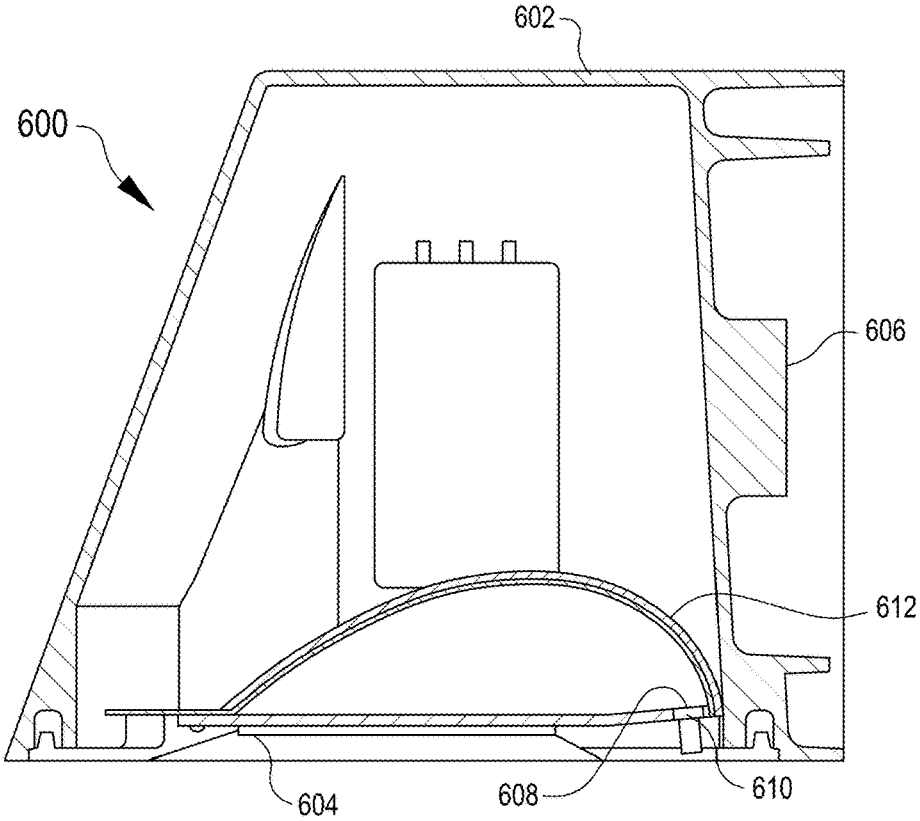
FIG. 7 shows a section view of the wall pack of FIG. 6, according to some embodiments.

FIG. 7 shows a section view of the wall pack 600 of FIG. 6 taken at plane B, according to some embodiments. The wall pack 600 includes the housing 602, window 604, and port 606 as described above. Driver electronics and wiring have been omitted from FIG. 7 for clarity of illustration, but it is to be understood that they are present as needed. The wall pack 600 also includes an LED 608, a PCB 610, and a reflector 612. The LED 608, PCB 610, and reflector 612 may have similar structures and makeup to the LED 104, PCB 106, and reflector 102 described above. Accordingly, more than one LED 608 may be present as shown and described with respect to FIG. 3.

The LED 608 and PCB 610 are shown directed generally towards an interior of the housing 602 in a direction approximately perpendicular to the window 604. The orientation of the LED 608 and the PCB 610 may ensure that the light from the LED 608 reflects against the reflector 612 and out of the housing 602 through the window 604 rather than reflecting back onto the PCB 610 and heating up the PCB 610 and LED 608. In some embodiments, the LED 608 and PCB 610 may be arranged as shown and described with respect to FIGS. 1 through 3 or FIG. 5. Furthermore, the truncated wall 212 of FIG. 2 and the associated reflector 202 may be substituted for the reflector 612. The reflector 612 receives the light from the LED 608 and directs the light through the window 604 out of the housing 602 to light the illuminated surface underneath and forward of the wall pack 600. The varying radius of the reflector 612 enables the light reflected off the reflector 612 and directed out through the window 604 to be thrown or directed substantially away from the housing 602 and the supporting structure (not shown) which the housing 602 connects to at the side of the housing 602.

The PCB 610 and LED 608 are thermally coupled to the housing 602, more specifically to a portion of the lower panel 614 to provide a conduit for heat to exit the housing 602. The lower panel 614 may be formed of metal or some other conductive material and thereby serve as a heat sink to receive and dissipate heat energy from the LED 608 and PCB 610. In some examples, the heat may be removed from the PCB 610 and LED 608 through passive means, such as convection and conduction with passive elements such as the lower panel 614. In some examples, such as high power applications, the wall pack 600 may include active heat removal systems such as cooling fans, heat exchangers, or other such cooling means.

FIG. 8 shows a photometric polar diagram 800 for an indirect light fixture, according to some embodiments. The photometric polar diagram 800 includes a first axis 804 and a second axis 806, the first axis 804 representing a vertical (y) axis and the second axis 806 representing a horizontal (x) axis. The first axis 804 and the second axis 806 are perpendicular to each other and include an origin 802 where they cross. In the photometric polar diagram 800, the distribution of light 808 by an indirect light fixture as described herein is shown, with the indirect light fixture placed at the origin 802. The light 808 is shown at varying intensities of light 808 depending on the illumination intensity of the LEDs. The indirect light fixture used to generate the photometric polar diagram is wall pack 400 of FIGS. 4 and 5.

In typical wall pack light fixtures, the light 808 washes the vertical surface of the supporting structure holding the wall pack light fixture. This is indicated by light displayed along the first axis 804, below the origin 802. In the photometric polar diagram 800 for the indirect light fixture, it is evident that the light 808 emanating from the indirect light fixture is thrown substantially away from the supporting structure to light the illuminated surface. As shown, the light 808 is primarily directed at an angle of less than sixty degrees with respect to the first axis 804. This indicates that the light 808 is not focused or wasted on illuminating the supporting structure but is rather directed away from the light fixture and towards the illuminated surface, where light is desired. This generates a more efficient use of light from the indirect light fixture in lighting a desired area as well as providing the benefits described herein of even light distribution and indirect, not visible, light sources for pleasing light fixture appearances to passers-by.

While the present subject matter has been described in detail with respect to specific aspects thereof, it will be appreciated that those skilled in the art, upon attaining an understanding of the foregoing, may readily produce alterations to, variations of, and equivalents to such aspects. Numerous specific details are set forth herein to provide a thorough understanding of the claimed subject matter. However, those skilled in the art will understand that the claimed subject matter may be practiced without these specific details. In other instances, methods, apparatuses, or systems that would be known by one of ordinary skill have not been described in detail so as not to obscure claimed subject matter. Accordingly, the present disclosure has been presented for purposes of example rather than limitation, and does not preclude the inclusion of such modifications, variations, and/or additions to the present subject matter as would be readily apparent to one of ordinary skill in the art. It will be apparent to those skilled in the art that various modifications and variations can be made in the method and system of the present invention without departing from the spirit or scope of the invention. Thus, it is intended that the present invention include modifications and variations that are within the scope of the appended claims and their equivalents. It is to be understood that any workable combination of the features and capabilities disclosed herein is also considered to be disclosed.

What is claimed is:

1. A light fixture for lighting an illuminated surface, the light fixture comprising:

a housing;

a plurality of light sources positioned within the housing and directed towards an interior of the housing;

a window of the housing through which light originating from the light sources passes to exit the housing, the plurality of light sources positioned adjacent a first edge of the window; and a reflector towards which light from the light sources is directed, the reflector extending from a location proximate the plurality of light sources to a second edge of the window opposite the first edge such that the reflector spans the window, the reflector extending along a first axis parallel to the plurality of light sources and the first edge of the window, a cross-section of the reflector perpendicular to the first axis having a length and being defined by a plurality of segments comprising, a first linear segment adjacent the first edge of the window;

a series of curved segments that follows the first linear segment along the length, wherein:

each of the curved segments in the series of curved segments has a radius of curvature different from its neighboring curved segments and curves concavely relative to the window; and a change in the radius of curvature is continuous between adjacent curved segments in the series of curved segments such that ends of adjacent curved segments connect along a common tangent line; and a second linear segment adjacent the second edge of the window, the second linear segment coupling the reflector to the housing proximate the second edge of the window, wherein no portion of the reflector spanning the window is convexly curved relative to the window and wherein the plurality of light sources and the reflector cooperate to direct light produced by the plurality of light sources onto the illuminated surface in an illumination field that is generally rectangular.

2. The light fixture of claim 1, wherein the series of curved segments defines a freeform curvature within a plane perpendicular to the first axis.

3. The light fixture of claim 2, wherein the freeform curvature is defined by a plurality of points connected by curved line segments.

4. The light fixture of claim 1, wherein a first curved segment in the series of curved segments has a first radius of curvature and a second curved segment in the series of curved segments has a second radius of curvature, wherein the first radius of curvature is different from the second radius of curvature.

5. The light fixture of claim 4, wherein:

the first curved segment is a first distance from the first edge of the window and the second curved segment is a second distance from the first edge of the window, the second distance being greater than the first distance; and the first radius of curvature is smaller than the second radius of curvature.

6. The light fixture of claim 1, further comprising a heat sink connected to the plurality of light sources.

7. The light fixture of claim 6, wherein the heat sink forms a portion of an access panel providing access to an interior of the housing.

8. The light fixture of claim 1, wherein each of the curved segments in the series of curved segments comprises a curvature having a profile of an arc segment of an ellipse.

9. The light fixture of claim 1, wherein each of the curved segments in the series of curved segments comprises a parabolic curvature.

10. The light fixture of claim 1, wherein each of the curved segments in the series of curved segments comprises a hyperbolic curve.

11. The light fixture of claim 1, wherein the first linear segment is positioned at an angle of between sixty and eighty degrees with respect to the window.

12. The light fixture of claim 1, wherein the reflector reflects light from the plurality of light sources and directs it away from a supporting structure to which the housing is connected.

13. The light fixture of claim 1, wherein the window comprises a textured surface to scatter light from the plurality of light sources.

14. The light fixture of claim 1, wherein the plurality of light sources comprise light emitting diodes (LEDs).

15. A light fixture comprising:

a light source that directs light in a first direction;

a heat transfer device connected to the light source to dissipate heat generated by the light source;

a window through which light originating from the light source passes, the light source directed away from the window; and a reflector positioned opposite the window in the first direction so as to span the window, the reflector having a first straight portion adjacent a first edge of the window, a curved portion, and a second straight portion adjacent a second edge of the window opposite the first edge, the curved portion interposed between the first straight portion and the second straight portion and comprising a series of curved segments, wherein each of the curved segments in the series of curved segments has a radius of curvature different from its neighboring curved segments and curves concavely relative to the window and wherein a change in the radius of curvature is continuous between adjacent curved segments in the series of curved segments such that ends of adjacent curved segments connect along a common tangent line, wherein no portion of the reflector spanning the window is convexly curved relative to the window and wherein the light from the light source reflects off the reflector towards the window.

16. The light fixture of claim 15, wherein a first curved segment in the series of curved segments has a first radius of curvature and a second curved segment adjacent the first curved segment in the series of curved segments has a second radius of curvature that is larger than the first radius of curvature.

17. The light fixture of claim 16, wherein the first curved segment is more proximate the first straight portion than the second curved segment.

18. The light fixture of claim 15, wherein the heat transfer device comprises a portion of an access panel to an interior of the light fixture.

* * * * *